US007506466B2

(12) United States Patent
Betham et al.

(10) Patent No.: US 7,506,466 B2
(45) Date of Patent: Mar. 24, 2009

(54) SIGN/BANNER SUPPORT

(76) Inventors: James Leroy Betham, 13921 Avenida Espana, La Mirada, CA (US) 90638; Michael Edward McCoy, 12112 Greenstone Ave., Santa Fe Springs, CA (US) 90670

( * ) Notice: Subject to any disclaimer, the term of this patent is extended or adjusted under 35 U.S.C. 154(b) by 218 days.

(21) Appl. No.: 11/396,144

(22) Filed: Mar. 31, 2006

(65) Prior Publication Data

US 2007/0234616 A1 Oct. 11, 2007

(51) Int. Cl.
*G09F 15/00* (2006.01)

(52) U.S. Cl. ..... 40/606.01; 40/607.03; 40/611.12; 40/607.14; 40/659; 248/230.7; 248/218.4; 248/297.51; 248/302

(58) Field of Classification Search ..... 40/606.01, 40/607.03, 611.12, 607.14, 658, 659, 602, 40/316; 248/230.7, 121, 125.1, 227.3, 228.7, 248/230.1, 218.4, 297.51, 302; 24/11 C, 24/546

See application file for complete search history.

(56) References Cited

U.S. PATENT DOCUMENTS 1,242,429 A * 10/1917 Enochty ..... 40/606.01
1,455,312 A * 5/1923 Turner ..... 248/125.1
1,865,835 A * 7/1932 Colby ..... 40/310
2,069,552 A 2/1937 Mikulasek
2,262,873 A * 11/1941 Wise ..... 40/607.12
2,607,092 A 8/1952 Rubly
2,636,704 A * 4/1953 Norberg ..... 248/79
2,774,562 A * 12/1956 Henry ..... 248/125.1
3,064,933 A * 11/1962 Brasty ..... 248/227.3
3,161,263 A * 12/1964 Stokes ..... 248/218.4
3,381,824 A * 5/1968 Blumenschein ..... 211/68
3,469,335 A * 9/1969 Leigh ..... 40/605
3,638,894 A * 2/1972 Leutenegger ..... 248/230.1
D233,017 S 10/1974 Hall
4,250,647 A 2/1981 Woodard
4,542,603 A * 9/1985 Streeter et al. ..... 40/447
4,730,803 A 3/1988 Hillstrom
4,809,894 A * 3/1989 Viio ..... 224/248
4,880,195 A 11/1989 Lepley
5,042,183 A * 8/1991 Kennedy ..... 40/607.06
5,212,898 A 5/1993 Dinan et al.
5,335,889 A 8/1994 Hopkins et al.
D362,465 S 9/1995 Gallemore, II
5,651,521 A * 7/1997 Aberg ..... 248/218.4
5,694,733 A 12/1997 Gallemore
6,085,452 A * 7/2000 Davis ..... 40/607.03
6,186,454 B1 2/2001 Olsen
6,209,837 B1 * 4/2001 Harms ..... 248/302

(Continued)

FOREIGN PATENT DOCUMENTS

DE 4207918 A1 * 9/1993

*Primary Examiner*—Gary C Hoge
(74) *Attorney, Agent, or Firm*—Robert T. Spaulding

(57) ABSTRACT

The improved sign/banner support is comprised of two parallel banner rods, each parallel to the vertical axis of a round or polygonal pole and each terminating in a cincture dimensioned to compressibly clinch the pole. The banner rods and cincture are comprised of a single length of a springable wire material. The rods are spaced to form an opening whereby the improved banner support may be presented to the pole. When mounted on the pole, the banner rods abut against the pole while the cincture forms an acute angle with respect to the vertical axis of the pole.

4 Claims, 3 Drawing Sheets

U.S. PATENT DOCUMENTS 6,338,212 B1 1/2002 Santa Cruz et al.
6,550,170 B1 4/2003 Cooper et al.
6,769,207 B1 8/2004 Brown et al.
2003/0024144 A1 2/2003 Jen
2003/0116688 A1* 6/2003 Furukawa ..... 248/339

* cited by examiner

SIGN/BANNER SUPPORT

BACKGROUND OF THE INVENTION

1) Field of the Invention

This invention relates generally to banner supports and more specifically to an improved banner support that may be easily installed on a pole or staff and resists any rotating or sliding motion that is created by wind pressure or other external forces.

2) Description of the Prior Art

U.S. Pat. No 6,769,207 B1 discloses a portable sign assembly in which the sign supports are attached to the outer surface of a flexible band that may be adjusted to fit different diameter drums. U.S. Pat. No. 6,550,170 B1 shows a pole-mounted sign that includes at least one flexible strap secured to the cradle for encircling the pole. Patent Application publication US 2003/0024144 A1 shows a pole with lifting mount and banner display that includes carriage locks to prevent vibration of the supported object. U.S. Pat. No. 6,338,212 B1 shows an advertisement display apparatus that includes a support rod which may be frictionally engaged within the support receptacle to increase stability. U.S. Pat. No. 6,186,451 B1 shows a post-mounted sign holder utilizing catching means to secure the device to a pole. U.S. Pat. No. 5,694,733 shows a flag/banner display system which uses bands capable of being tightened around the support pole for the securement of the bracket thereagainst. U.S. Pat. No. 5,335,889 shows a bracket mountable to an upright support for holding a sign. Fastener bands are utilized to connect a bracket, which prevents sign flexure, to a pole. U.S. Pat. No. 5,212,898 shows a pole sign construction in which wing nuts are used to fasten the corrugated plastic board sheets to the hardware and thus to the pole. U.S. Pat. No. 4,880,195 shows a banner support in which the support assembly may be fastened to the pole by means of a flexible strapping or by means of a bolt. U.S. Pat. No. 4,730,803 shows a ground access elevated pole banner in which a track assembly can be secured to the surface of the pole by way of one or more clamps. U.S. Pat. No. 4,250,647 shows a fast mount sign hanger which requires a unique T-shaped pole. U.S. Pat. No. 2,607,092 shows a clamp for cylindrical objects utilizing a flexible strap. U.S. Pat. No. 2,069,552 shows a roll for ironing machines that is secured in place by a flexible strap secured by a threaded mechanism. U.S. Pat. No. Des. 362,465 shows a portable sign in which the sign is secured to a pole by a hook and latch mechanism. U.S. Pat. No. Des. 233,017 shows a street sign-supporting bracket that is secured to a pole by screws or bolts.

None of the above listed patents secure a banner support by compressibly clinching a round pole whereby the cincture forms an acute angle with respect to the axis of the pole.

The present invention provides an inexpensive signage/information assembly which may be easily mounted and positioned on vertical poles of varying cross sections without the use of threaded fasteners or other attaching methods as described in the prior art. The present invention may be used for both indoor and outdoor displays. It is readily re-positioned on the pole.

Applicants hereby incorporate herein by reference any and all U.S patents, patent applications, and other documents and printed matter cited or referred to in this application.

SUMMARY OF THE INVENTION

The Improved Sign/Banner Support is comprised of a cincture dimensioned to compressibly clinch a round or polygonal pole, further including an opening thereby allowing the cincture to be presented to the pole. Each end of the cincture terminates in a banner rod, each splayed laterally so that the rods form a thirty degree included angle. Collectively, the banner rods form an acute angle with respect to the cincture. One rod is slightly longer than the other is, and the overall length of each rod is determined by the size of the core board which is to be supported. The banner rods and cincture consist of a single length of a springable wire material. This material is coated with a material having corrosion resistant properties and a high co-efficient of friction. When mounted on a pole, the banner rods are parallel to the vertical axis of the pole. The acute angle formed by the juncture of the rods and cincture causes the mounted cincture to form an acute angle with respect to the vertical axis of the pole. The core board comprises a generally rectangular shape and includes a plurality of parallel vertical slots dispersed along the lower horizontal axis and extending internally to the upper horizontal axis. These openings are dimensioned to accept a banner rod. To install the core board, the banner rods are compressed so that they are parallel to one another, and then sequentially inserted into an appropriate slot in the core board. This assembly is now pre-loaded in a cinching frictional and mechanical locking manner.

By incorporating an acute angle rather than forming a traditional right angle between the rods and the cincture, new and unexpected results occur. The cincture forms a semi-elliptical form that extends beyond the minor axis of the sloped elliptical form and any rotational force applied across the inclined plane with respect to the vertical axis of the pole would cause a physical wire and pole interface, thereby creating a mechanical locking.

BRIEF DESCRIPTION OF THE DRAWINGS

FIGS. 1-3 further include a mounted banner 8.

DESCRIPTION OF THE PRESENTLY PREFERRED EMBODIMENT

Figure 1:
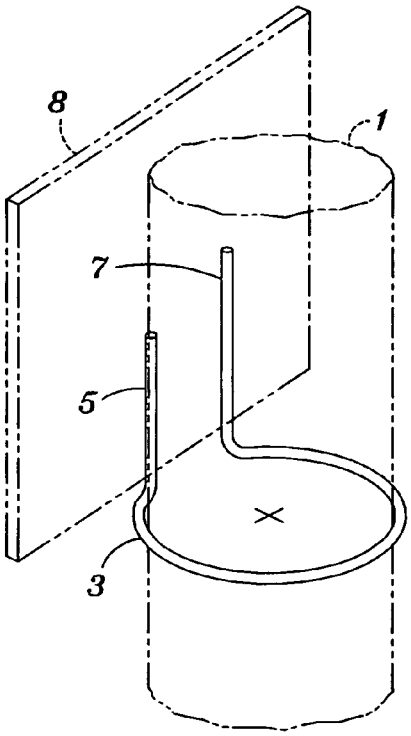
FIG. 1 (PRIOR ART)
FIG. 1 is a perspective view of a prior art banner support as mounted on a round pole.
Figure 2:
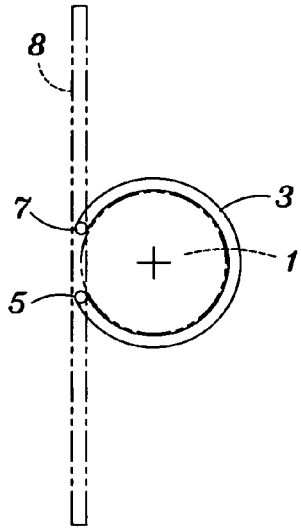
FIG. 2 (PRIOR ART)
FIG. 2 shows a plan view of the mounted prior art banner support.
Figure 3:
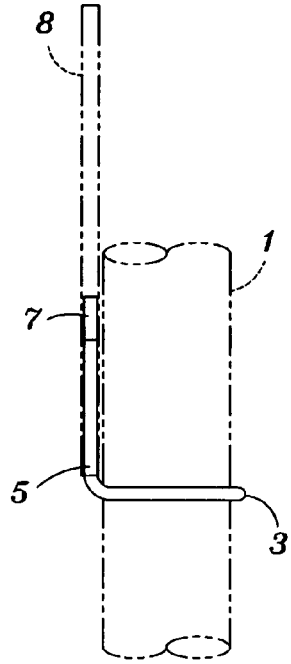
FIG. 3 (PRIOR ART)
FIG. 3 shows the mounted prior art banner support in profile with respect to the round pole.
Figure 4:
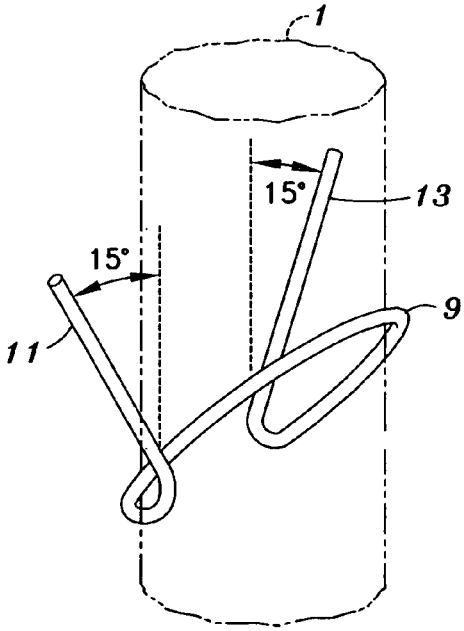
FIG. 4 is a perspective view of the present invention as mounted on a round pole.
Figure 5:
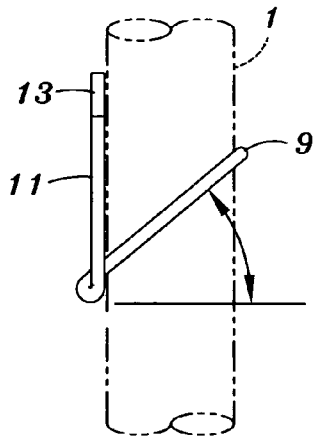
FIG. 5 shows the present invention in profile with respect to the round pole.
Figure 6:
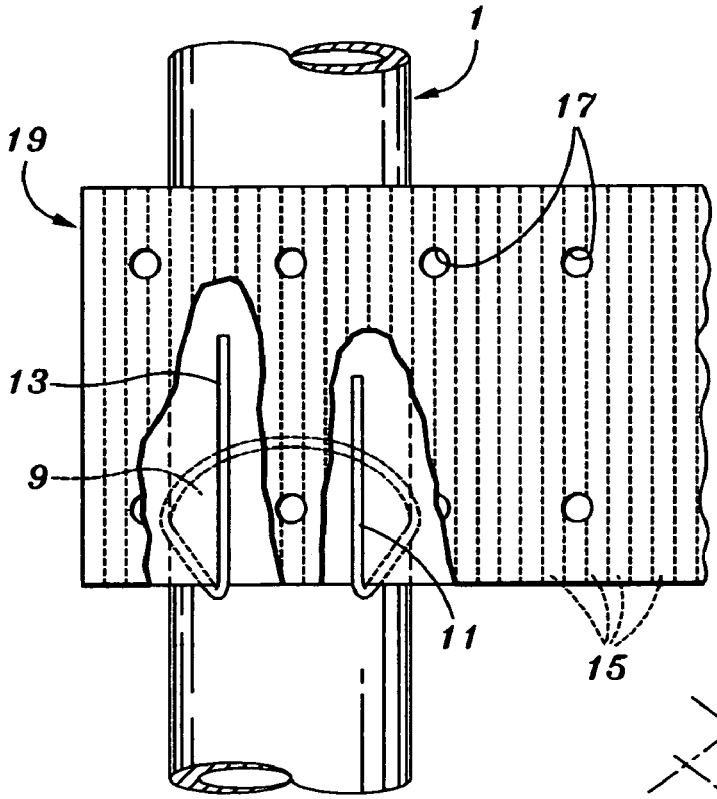
FIG. 6 is cutaway view that shows the Improved Sign/Banner Support mounted on a pole. Here, the relationship between the parallel banner rods and the core board may be clearly seen.
Figure 9:
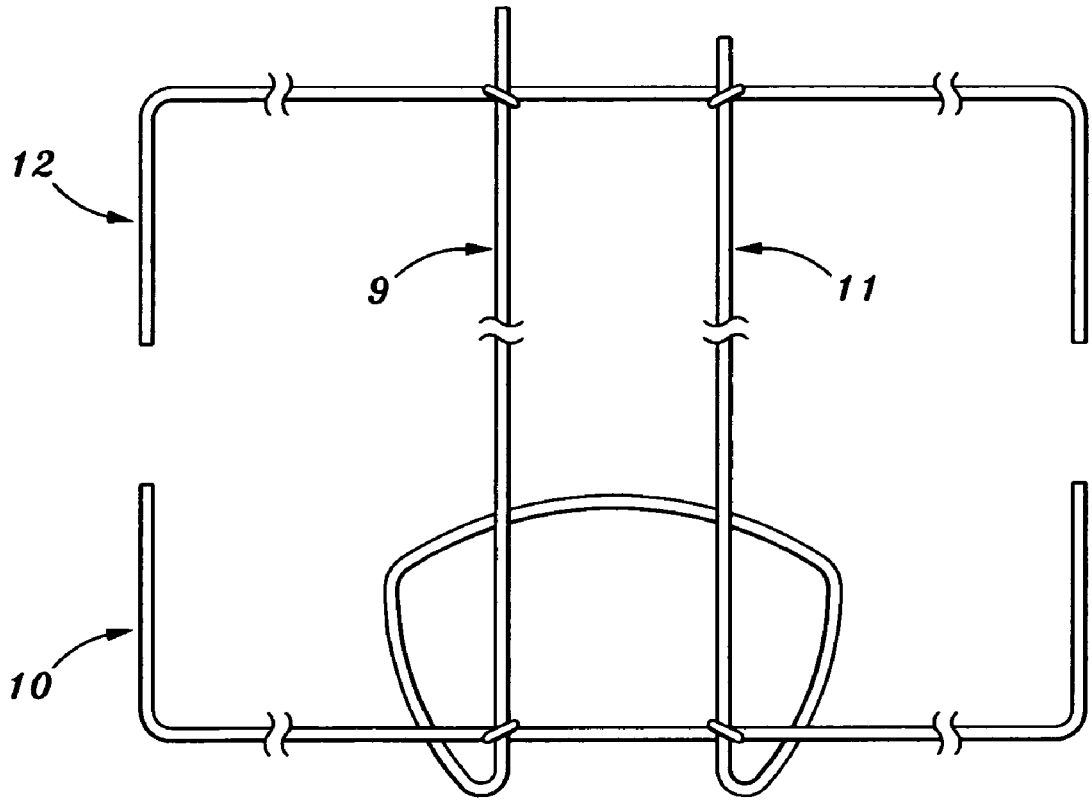
FIG. 9 shows a view of the alternate embodiment in which two outrigger assemblies are attached to the proximal ends of the parallel banner rods.

FIGS. 1, 2, and 3 depict the prior art and are included so that comparisons may be made to the improved sign/banner support. FIG. 4 shows a cutaway perspective view of an improved sign/banner support, here mounted on a round pole 1. The improved sign/banner support may be configured to mount on poles of varying polygonal shapes. In this view, the relationship between the pole and two banner support rods 13 and 11 (5 and 7 in prior art FIGS. 1, 2 and 3), and a cincture 9 (3 in prior art FIGS. 1, 2, and 3) may be clearly seen. The cincture, dimensioned to compressibly clinch the pole, further includes an opening thereby allowing it to be presented to the pole. Each end of the cincture terminates in a banner rod, each splayed laterally so that the rods form a thirty degree included angle. Collectively, the banner rods form an acute angle with respect to the cincture. One rod is slightly longer than the other is, and the overall length of each rod is determined by the size of a core board—19 in FIG. 6—which is to be supported The banner rods and cincture consist of a single length of a springable wire material. The wire is coated with a material having corrosion resistant properties and a high coefficient of friction. When mounted on a pole, the banner rods are parallel to the vertical axis of the pole. Further included in the view of the short support rod 11 is an alternate embodiment comprising at least one three hundred sixty degree twist that is incorporated at the proximal end of the rod to increase torsional force. In practice, both rods would be so modified. As may be seen in FIG. 6, the acute angle formed by the juncture of the rods 11 and 13, and the cincture 9 causes the mounted cincture to form an acute angle with respect to the vertical axis of the pole. A core board 19 comprising a generally rectangular shape and including a plurality of parallel vertical slots 15 dispersed along the lower horizontal axis and extending internally to the upper horizontal axis is shown in the mounted position. The slots are dimensioned to accept the two banner rods. To install the core board, the banner rods are compressed so that they are parallel to one another, and then sequentially inserted into an appropriate slot in the core board. The banner rods include serrations at the distal ends, which provide for locking means within the matching slots. This assembly is now pre-loaded in a cinching frictional and mechanical locking manner. The spacing of the vertical slots in the core board may be varied so that the degree of preloading attained by the inward closing of the banner rods may be adjusted as desired for either indoor or outdoor use. A further embodiment incorporates a plurality of openings 17, in the core board which reduce wind loading. In the event that a core board is too wide to be contained by the banner rods, an alternate embodiment comprises at least one outrigger, 10 in FIG. 9, comprised of the same wire material. For clarity, the pole to which the banner support is mounted and the core board are not included in FIG. 9. Each outrigger includes a horizontal member of sufficient length to accommodate the wide core board. The horizontal member terminates in two upwardly directed vertical auxiliary banner rods. The overall length of each auxiliary rod is determined by the size of the core board. The horizontal member further includes two three hundred and sixty degree twists spaced symmetrically about the center of the horizontal member and dimensioned so that the twists may be presented to the banner rods 9 and 11 of the improved sign/banner support. By inserting the banner rods through the twists and sliding the outrigger down so that the twists abut against the junctions of the banner rods and the cincture, the outrigger becomes fixed in place. To install the wide core board, the innermost banner rods are compressed so that they are parallel to one another, and then the plurality of banner rods are sequentially inserted into appropriate slots in the wide core board. The banner rods and core board cooperate to form an assembly that is pre-loaded in a cinching frictional and mechanical locking manner. To further enhance the rigidity of the wide core board, another similarly dimensioned outrigger 12 in which the auxiliary banner rods are downwardly directed, may be installed over the support rods 9 and 11. By sliding the outrigger down and into appropriate vertical slots in the core board so that the twists abut against the upper horizontal axis of the wide core board, the outrigger becomes fixed in place; the banner rods and core board cooperate to form an assembly that is pre-loaded in a cinching frictional and mechanical locking manner.

Figure 7:
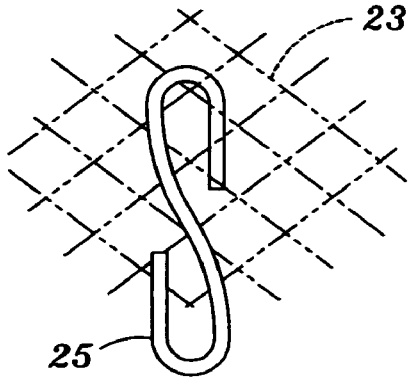
FIG. 7 shows an alternate embodiment of the present invention as mounted on a chain link fence.

FIG. 7 depicts an alternate embodiment of the improved sign/banner support that is configured to be mounted on a chain link fence 23. The banner support consists of a single length of a springable wire material shaped in the form of a figure eight 25. To install, the improved banner support is vertically positioned over a section of the chain link fence so that the upper segment of the figure eight forms a cincture about the section of chain link fence. The banner support is now positioned so that a banner or sign may be inserted into the lower segment of the banner support where it is compressibly held in place by the tautness of the wire material.

Figure 8:
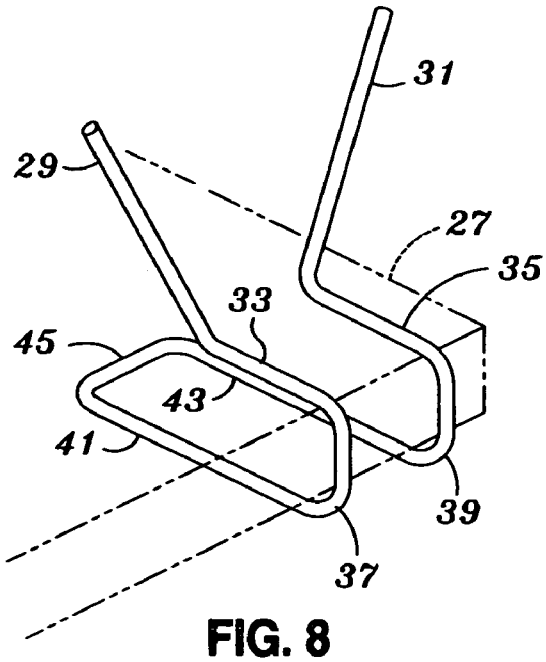
FIG. 8 shows a perspective view of an alternate embodiment of the present invention as mounted on the edge of a table or desk.

FIG. 8 depicts an alternate embodiment of the improved sign/banner support that is configured to be mounted on a flat surface 27 such as a table or a bench. The banner support consists of a single length of a springable wire material comprising two parallel vertical banner rods 29 and 31 each splayed laterally so that the rods form a thirty degree included angle. To facilitate mounting a banner or a rigid sign made of a material such as cardboard; one banner support rod is longer than the other is. The banner rods terminate in two parallel upper mounting brackets 33 and 35. The two upper mounting brackets in turn form right angles with mounting rods 37 and 39. The mounting rods are dimensioned to span the thickness of the table or bench to which the banner support will be attached. The mounting rods terminate in two parallel lower mounting brackets 43 and 44 which in turn each terminate in a connecting bracket 45. To install, the sign/banner support is presented to the table or bench and pressed into place so that the mounting rods abut against an edge of the table or bench. The upper and lower mounting brackets cooperate to compressibly hold the sign/banner support in place. To install the core board,—19 in FIG. 6—the banner rods are compressed so that they are parallel to one another, and then sequentially inserted into an appropriate slot in the core board. The banner rods include serrations at the distal ends, which provide for locking means within the matching slots. This assembly is now pre-loaded in a cinching frictional and mechanical locking manner.

Although the description above contains many specifications, these should not be construed as limiting the scope of the invention, but as merely providing illustrations of some of the presently preferred embodiments of the invention.

What is claimed is:

1. An improved sign/banner support assembly comprised of a generally rectangularly shaped core board and two parallel banner rods, each terminating in an acute angle with respect to a cincture dimensioned to compressibly clinch a round or polygonal pole, and formed of a single length of a springable, flexible wire material, said rods, which are spaced to include an opening allowing the improved banner support to be presented to the pole so that the rods are positioned parallel to the vertical axis of the pole and abut against the pole allowing the core board to be mounted between the rods and pole and held in place in a cinching frictional and mechanical locking manner; said cincture forming an acute angle with respect to the vertical axis of the pole and not sharing a common axis with the pole, hence defining a semi-elliptical shape, which generates a mechanical interference to rotational forces through the plane of the elliptic and provides for a more readily contactable interface between the cincture and the pole so that the installed sign/banner support assembly adopts a fixed position on the pole, allowing simultaneous manipulation of both banner rods during mounting of the core board.

2. The improved sign/banner support assembly of claim 1, in which the assembly's resistance to vertical or rotational movement is increased due to the bending moment across the pole resulting from any downward loading of the core board.

3. The improved sign/banner support assembly of claim 1, in which by causing a rotation of the plane of the semi-elliptical form to a horizontal position, the assembly may be moved readily up or down: secure locking of the assembly is achieved by returning the assembly to its original clamped position.

4. An improved sign/banner support assembly comprising:

a generally rectangularly shaped core board having a lower and upper horizontal axis and including a plurality of parallel vertical slots dispersed along the lower horizontal axis and extending internally to the upper horizontal axis;

a round or polygonal pole;

two parallel banner rods, each terminating in an acute angle with respect to a cincture dimensioned to compressibly clinch the round or polygonal pole and formed of a single length of a springable, flexible wire material; said rods spaced to include an opening, allowing the improved banner support to be presented to the pole so that the rods are positioned parallel to the vertical axis of the pole and abut against the pole, each rod pre-loaded and dimensioned to cooperate with the vertical slots of the core board thereby allowing the core board to be mounted between the rods and pole and compressibly held in place, cinching in a frictional and mechanical locking manner;

said cincture forming an acute angle with respect to the vertical axis of the pole and not sharing a common axis with the pole, hence defining a semi-elliptical shape, which generates a mechanical interference to rotational forces through the plane of the elliptic and provides for a more readily contactable interface between the cincture and the pole so that the installed sign/banner support assembly adopts a fixed position on the pole, allowing simultaneous manipulation of both banner rods during mounting of the core board.

* * * * *